US005223473A

United States Patent [19]

Oliver et al.

[11] Patent Number: 5,223,473

[45] Date of Patent: Jun. 29, 1993

[54] SELF-CLEANING CARBONLESS PAPER

[75] Inventors: John F. Oliver, Mississauga; David J. Sanders, Oakville, both of Canada

[73] Assignee: Xerox Corporation, Stamford, Conn.

[21] Appl. No.: 616,501

[22] Filed: Nov. 21, 1990

[51] Int. Cl.[5] ..... B41M 5/124

[52] U.S. Cl. ..... 503/226; 427/152; 503/200; 503/207

[58] Field of Search ..... 503/200, 207, 226; 427/150-152

[56] References Cited

U.S. PATENT DOCUMENTS

| | | | |
|---|---|---|---|
| 2,249,118 | 7/1941 | DeWitt | 91/68 |
| 2,368,635 | 2/1945 | Booth | 92/21 |
| 2,599,094 | 6/1952 | Craig | 92/3 |
| 2,786,757 | 3/1957 | Taylor | 92/21 |
| 2,786,758 | 3/1957 | Taylor | 92/21 |
| 2,888,377 | 5/1959 | Allen | 162/181 |
| 2,919,222 | 12/1959 | Hall, Jr. | 162/181 |
| 2,929,736 | 3/1960 | Miller et al. | 117/36 |
| 2,935,438 | 5/1960 | Craig | 162/181 |
| 2,980,941 | 4/1961 | Miller | 15/506 |
| 3,481,759 | 12/1969 | Ostlie | 117/36.2 |
| 3,776,864 | 12/1973 | Woerner | 260/17 R |
| 3,801,433 | 4/1974 | Windle | 162/181 D |
| 4,036,511 | 7/1977 | Maalouf | 503/226 |
| 4,046,404 | 9/1977 | Treier | 282/27.5 |
| 4,089,547 | 5/1978 | Brynko et al. | 282/27.5 |
| 4,154,462 | 5/1979 | Golden et al. | 282/27.5 |
| 4,398,954 | 8/1983 | Stolfo | 106/21 |
| 4,440,827 | 4/1984 | Miyamoto et al. | 428/327 |
| 4,478,910 | 10/1984 | Oshima et al. | 428/331 |
| 4,554,181 | 11/1985 | Cousin et al. | 427/261 |
| 4,580,152 | 4/1986 | Takigawa et al. | 346/201 |
| 4,636,410 | 1/1987 | Akiya et al. | 427/261 |
| 4,734,336 | 3/1988 | Oliver et al. | 428/537.5 |
| 4,778,711 | 10/1988 | Hosomura et al. | 428/211 |
| 4,792,487 | 12/1988 | Schubring et al. | 428/342 |
| 4,906,605 | 3/1990 | Kraft | 503/215 |

*Primary Examiner*—Pamela R. Schwartz
*Attorney, Agent, or Firm*—Judith L. Byorick

[57] ABSTRACT

Disclosed is a carbonless paper set having at least two sheets, wherein a first sheet comprises paper coated on one surface with a color former and a second sheet comprises paper coated on one surface with a color developer, and wherein at least one of the sheets contains an oleophilic pigment filler material on the surface of the sheet opposite to that coated with the color former or color developer. Also disclosed is a process for generating images which comprises generating an electrostatic latent image on an imaging member in an imaging apparatus, developing the latent image with toner particles of one polarity, contacting the developed image on the imaging member with the first sheet of the carbonless paper set disclosed herein, applying an electric charge of a polarity opposite to that of the toner particles to the surface of the first sheet opposite the surface in contact with the imaging member, thereby transferring the developed image to the first sheet, generating an electrostatic latent image on the imaging member in the imaging apparatus, developing the latent image with toner particles of one polarity, contacting the developed image on the imaging member with the second sheet of the carbonless paper set disclosed herein, applying an electric charge of a polarity opposite to that of the toner particles to the surface of the second sheet opposite the surface in contact with the imaging member, thereby transferring the developed image to the second sheet, and optionally permanently affixing the transferred images to the first and second sheets.

16 Claims, 7 Drawing Sheets

SELF-CLEANING CARBONLESS PAPER

BACKGROUND OF THE INVENTION

The present invention is directed to a carbonless paper which can be employed in electrophotographic imaging processes. More specifically, the present invention is directed to a carbonless paper set having at least two sheets, wherein a first sheet comprises paper coated on one surface with a color former, and a second sheet comprises paper coated on one surface with a color developer, and wherein at least one of the sheets contains an oleophilic pigment on the surface of the sheet opposite to that coated with the color former or color developer. One embodiment of the present invention is directed to a carbonless paper set which comprises a first sheet comprising a first paper support comprising paper fibers, said first paper support being coated with a color former, and a second sheet comprising a second paper support comprising paper fibers, said second paper support being coated with a color developer, wherein at least one of the paper supports contains an oleophilic pigment filler material within the paper fibers. Another embodiment of the present invention is directed to a carbonless paper set which comprises a first sheet comprising a first paper support comprising paper fibers, said first paper support being coated with a color former, and a second sheet comprising a second paper support comprising paper fibers, said second paper support being coated with a color developer, wherein at least one of the paper supports contains an oleophilic pigment filler material coated onto the surface of the support opposite to the surface coated with the color former or color developer.

Carbonless paper sets generally are stacks of at least two sheets of paper wherein the application of pressure in imagewise fashion on the top sheet, typically by handwriting or typing, results in formation of a corresponding image on the underlying sheets, so that copies are formed as the image is generated on the top sheet. Carbonless paper sets typically comprise a top sheet of paper, on the bottom surface of which is coated a first composition, and a bottom sheet, on the top surface of which is coated a second composition. The first and second compositions are in contact with each other when the top and bottom sheets are placed in stack formation, and generally are of a nature such that application of pressure to the top sheet of the stack at a specified location causes interaction between the first and second compositions that results in the formation of a colored area on the bottom sheet at the location at which pressure was applied. Intermediate sheets can be located between the top and bottom sheets, wherein each intermediate sheet is coated on its top surface with the second composition and on its bottom surface with the first composition; application of pressure to the top sheet then results in the formation of a colored area at the location at which pressure was applied on each of the intermediate sheets and on the bottom sheet.

An example of a carbonless paper set is disclosed in U.S. Pat. No. 3,843,383, the disclosure of which is totally incorporated herein by reference. This patent discloses a recording sheet comprising a support having thereon a layer of color developer capable of reacting with a substantially colorless color former to form colored images. The paper set generally comprises a top sheet coated with microcapsules containing a color former solution, a bottom sheet coated with a color developer material in a binder, and, in some instances, middle sheets coated on one surface with the color developer and on the other surface with the color former microcapsules. Contacting a top sheet coated with color former containing microcapsules on its bottom surface with a bottom sheet coated on its top surface with a color developer and applying pressure to the paper "sandwich" thus formed results in formation of a color image. Other patents disclosing carbonless paper of this type include U.S. Pat. No. 2,712,507 and U.S. Pat. No. 2,730,456, the disclosures of which are totally incorporated herein by reference. Alternatively, as disclosed in U.S. Pat. No. 2,730,457, the disclosure of which is totally incorporated herein by reference, the color former microcapsules and the color developer of a carbonless paper can be applied to the same surface of a paper sheet. Other configurations of color former, color developer, and a pressure-releasable liquid solvent are possible, including, for example, those disclosed in U.S. Pat. No. 3,672,935, the disclosure of which is totally incorporated herein by reference. Additional patents disclosing carbonless papers and materials suitable for carbonless paper applications include U.S. Pat. No. 2,417,897, U.S. Pat. No. 3,672,935, U.S. Pat. No. 3,681,390, U.S. Pat. No. 4,202,820, U.S. Pat. No. 4,675,706, U.S. Pat. No. 3,481,759, U.S. Pat. No. 4,334,015, U.S. Pat. No. 4,372,582, U.S. Pat. No. 4,334,015, U.S. Pat. No. 2,800,457, U.S. Pat. No. 2,800,458, U.S. Pat. No. 3,418,250, U.S. Pat. No. 3,516,941, U.S. Pat. No. 4,630,079, U.S. Pat. No. 3,244,550, U.S. Pat. No. 3,672,935, U.S. Pat. No. 3,732,120, U.S. Pat. No. 3,843,383, U.S. Pat. No. 3,934,070, U.S. Pat. No. 3,481,759, U.S. Pat No. 3,809,668, U.S. Pat. No. 4,877,767, U.S. Pat. No. 4,857,406, U.S. Pat. No. 4,853,364, U.S. Pat. No. 4,842,981, U.S. Pat. No. 4,842,976, U.S. Pat. No. 4,788,125, U.S. Pat. No. 4,772,532, and U.S. Pat. No. 4,710,570, the disclosures of each of which are totally incorporated herein by reference.

Often, carbonless papers are passed through mechanical devices that include automated paper handling systems. Such devices include printers, copiers, and duplicators for imprinting information on the carbonless sheets, as well as automatic sorting devices such as magnetic card readers and Optical Character Recognition devices for reading coded information from the carbonless sheets. All such devices contain pressure nips, including, for example, those between elements of the paper transport system such as feed belts and wheels, retard rollers, pinch rollers, and the like. When carbonless paper is passed through these devices, these elements come into contact with the surfaces of the carbonless sheets, and often become contaminated with components of the carbonless color forming coating, color developer coating, or both, which may produce a deleterious effect on the continued operation of the device. In particular, the microcapsules of the carbonless color former layer can become ruptured in a pressure nip, causing the color former solution to be deposited on one or both elements of the nip. This material may interact with other components of the carbonless coatings, or with components of other throughput materials, causing contamination and failure of the device.

For example, frequently, it is desirable to generate images on carbonless paper sets in electrophotographic copiers and duplicators. In such instances, each sheet of paper in a stack is fed sequentially into the imaging apparatus, wherein an electrostatic latent image of one polarity is formed on an imaging member. The image is then developed with a toner charged to a polarity opposite to that of the latent image, and the developed image is transferred to the paper. Transfer is frequently effected by applying an electric charge of the same polarity as the latent image (and opposite of the polarity on the toner particles) to the back of the paper sheet. The charge applied to the back of the sheet is of greater magnitude than the charge of the latent image, which results in the toner particles becoming attracted to the paper and thus transferred from the imaging member to the paper. The charge may be applied in a non-contact manner by an ion deposition device, such as a corotron, scorotron, or similar device, or by contacting the back of the sheet by a charged roller conventionally known as a bias transfer roller. When a bias transfer roller is used, the paper passes through a nip formed between the imaging member and the bias transfer roller. After transfer to the paper, the image is generally fused to the paper by conventional methods, such as application of heat, pressure, or the like. Subsequent to fusing, the stack is reassembled so that the sheets are in their proper sequence in the stack.

When carbonless paper sets are passed through copiers and duplicators, frequently a problem arises with contamination of the imaging member with tackified clusters of toner. As the carbonless paper sheets pass through the imaging device, portions of the color former composition coating the paper sheets become transferred onto the imaging member, either as a result of direct contact between the imaging member and the coated paper, or indirectly as a result of contact between the coated paper and the bias transfer roll and subsequent contact between the bias transfer roll and the imaging member, which are in intimate contact prior to and subsequent to the passage of a sheet between them. Toner particles then accumulate on areas of the imaging member where portions of the coating composition are located and become tackified, thus contaminating the imaging member. Similar difficulties with contamination can occur at other pressure nips in an imaging device, such as that formed by contact between paper feeding components, or that formed by two fuser rolls. Similar contamination problems can also occur at pressure nips in other mechanical devices with automated paper handling systems.

U.S. Pat. No. 4,906,605, the disclosure of which is totally incorporated herein by reference, discloses a carbonless copy paper for imaging via electrostatic copiers comprising a paper stock having a basis weight greater than about 18 pounds per ream and containing on at least a portion of a surface thereof a stilt particle-free composition comprising microcapsules, at least 50 volume percent thereof having a size no greater than about 12 microns and at least 95 percent by volume thereof having a size no greater than about 18 microns. The reference discloses reduced contamination of the bias transfer roll and imaging member in an electrophotographic device by carbonless color former sheets with a coating of microcapsules within the disclosed particle size range. By eliminating larger sized microcapsules which are most prone to breakage, the amount of solvent oil released in the pressure nip between the transfer roll and imaging member is reduced. This approach, however, cannot totally eliminate solvent oil contamination of the imaging member, since on each carbonless color former sheet, a number of microcapsules will have been broken during manufacture of the sheet (during either the coating or sheeting operations), or during subsequent packaging, transportation, and handling of the finished product, or during feeding and transport of the sheet into the electrophotographic device. Solvent oil from such inadvertently ruptured microcapsules is still available to cause contamination of the bias transfer roll and imaging member.

In addition, U.S. Pat. No. 4,398,954, the disclosure of which is totally incorporated herein by reference, discloses a coating composition comprising oil-containing microcapsules dispersed in an aqueous continuous phase, which phase also contains finely divided silica particles and a binder for the microcapsules and silica particles. The silica particles have been treated with an organic material such as an organic silicon compound to give the particles a hydrophobic surface. The coating composition can be used in the manufacture of paper coated with microcapsules. The paper is characterized by a substantial reduction of specking when used in photocopying apparatuses using a pressure nip to assist transfer of a powder image from a photoreceptor belt to paper. In a preferred embodiment, the coated paper is used in the production of multipart forms. The reference discloses reduced contamination of the bias transfer roll and imaging member of an electrophotographic device by means of incorporating finely divided silica particles and a binder along with microcapsules in a carbonless color former coating. The silica particles are apparently intended to absorb the solvent oil from inadvertently ruptured microcapsules before it can transfer to the bias transfer roll or imaging member. However, there is a limit to the amount of solvent oil that can be absorbed in the color former coating without impairing the image forming capabilities of the carbonless set. By its nature, a carbonless color former sheet must be able to release from its surface substantial amounts of color former dissolved in solvent oil, which can then transfer to the color developing sheet where the color former and color developer react to form the carbonless image.

The present invention reduces or eliminates these problems by providing a carbonless paper set that is "self-cleaning". Incorporated during manufacture into the base paper of the top sheet, the bottom sheet, or both the top and bottom sheets of the carbonless paper stack of the present invention is a pigment material that tends to absorb rapidly the coating material that has been transferred to the upper or lower elements of a pressure nip through which the carbonless paper has been passed, such as, for example, the imaging member of the bias transfer roll in an electrophotographic imaging device. Thus, when the carbonless paper stack is fed sequentially into the imaging device, an uncoated surface of the paper containing the pigment material contacts the imaging member, the bias transfer roll, or both, thereby absorbing the coating material, typically a carbonless oil, on the imaging member or bias transfer roll and removing it therefrom. Since the coating material is periodically removed by the oil absorbing pigment material in the "self-cleaning" paper either from the imaging member and/or the transfer roll, contaminating accumulations of tackified toner deposits do not form on the imaging member. A similar self-cleaning process occurs at other pressure nips in the imaging device, or at pressure nips in other devices, thus also reducing contamination at these sites.

U.S. Pat. No. 4,046,404, the disclosure of which is totally incorporated herein by reference, discloses a carbonless paper suitable for use in electrostatographic copiers. The paper comprises a base sheet of paper making fibers having uniformly dispersed therein from about 0.05 to 10 percent by weight of hollow, generally spherical particles ranging in diameter from about ½ to 200 microns in diameter. These particles serve the purpose of increasing the stiffness and caliper of the paper sheet. The carbonless paper also contains a color forming material encapsulated in discrete particles and/or a color developing material.

The incorporation of oleophilic pigments into paper in general is known. For example, U.S. Pat. No. 2,935,438, the disclosure of which is totally incorporated by reference, discloses a process for incorporating fillers and pigments into paper. Incorporation of the filler or pigment is intended to impart improved physical and optical properties to the paper, increase the volume or bulk of the paper, impart to the paper opacity, brightness, or color, and result in good surface smoothness, absorption, and ink receptivity of the paper. The process entails reacting precipitated hydrated calcium silicate with aluminum sulfate in an aqueous medium so that at least 50 percent of the calcium silicate is in the solid phase to form a finely divided insoluble reaction product of the calcium silicate and the aluminum sulfate. The insoluble product may then be added to the pulp slurry during manufacture, or it may be later applied to the formed paper sheet.

In addition, U.S. Pat. No. 2,249,118, the disclosure of which is totally incorporated herein by reference, discloses a soft, flexible, durable paper which may be used in the manufacture of articles commonly made of textile fabrics. The paper retains its softness and durability whether wet or dry, and can be cut and sewn like cloth. These characteristics are obtained by incorporating into the paper a sizing material consisting essentially of softening agents, such as glycerine or other stable water soluble liquids with a higher boiling point than water, dissolved in water, and a water insoluble mineral filler, which filler fixes or anchors the softening agent in the paper so that it will not dissolve or evaporate. The filler materials act as adsorbents to retain the softening agent in the paper and distribute it throughout the paper. Suitable fillers include calcium, magnesium, and aluminum oxides, aluminum silicates such as kaolin, fuller's earth, and pumice, and silicates, carbonates, sulfates, and fluorides of calcium and magnesium.

Further, U.S. Pat. No. 4,580,152, the disclosure of which is totally incorporated herein by reference, discloses a method for carrying out heat sensitive transfer which comprises using a transfer sheet having a leuco dye-containing transfer layer and a receiving sheet having a receiving layer containing a bisphenol-system compound and a porous filler whose oil absorption is 50 ml/100 g or more and bringing the transfer sheet into contact with a thermal head. Examples of porous fillers include inorganic fine powders of silica, aluminum silicate, alumina, aluminum hydroxide, and magnesium hydroxide, and organic fine powders of urea-formalin resin and styrene resin, with a particle diameter of 0.01 to 10 microns.

Additionally, U.S. Pat. No. 3,801,433 discloses a process for reducing the deposition of pitch during paper manufacturing by adding to the pulp from which paper is to be made a quantity of a clay pigment which has been coated with an organic material that adheres strongly to the clay pigment and that renders the surface of the pigment particles oleophilic. The organic material generally is an organic amine, its water-soluble salt, its reaction product with alkylene oxides, an alkyl pyridinium salt, a quaternary ammonium salt, or a mixture thereof, and is applied to the clay pigment in an amount of from 0.5 to 5 percent by weight of the pigment. One suitable clay pigment is kaolinitic clay. The coated pigment is added to the pulp during paper manufacture, and reduces deposition of pitch during manufacture.

Other references disclosing the use of pigments and clays in paper include U.S. Pat. No. 2,368,635, the disclosure of which is totally incorporated herein by reference, which discloses a method of forming a sheet of paper or a ply of paperboard from a dilute suspension of fibers. Preferably, a preformed aluminum silicate mineral is applied to the fiber suspension. The aluminum silicate physically separates the fibers in water so that a more uniform distribution is obtained. In addition, U.S. Pat. No. 2,599,094, the disclosure of which is totally incorporated herein by reference, discloses paper containing a cellulosic fiber and calcium silicate pigment. The pigment comprises highly pigmented cellulosic pulp fibers containing finely divided hydrated calcium silicate precipitated largely within the fibers and on and around the fibers in an amount greatly exceeding the weight of the fibers. Further, U.S. Pat. No. 2,786,757, the disclosure of which is totally incorporated herein by reference, discloses a process for preparing a paper product with high brightness and opacity by forming a paper pulp dispersion in an aqueous acidic material which forms a substantially water-insoluble salt of an alkaline earth metal and adding calcium silicate or an equivalent alkaline earth metal silicate to the acidic slurry. U.S. Pat. No. 2,786,758, the disclosure of which is totally incorporated herein by reference, discloses a process for preparing paper containing a siliceous pigment. The pigment is prepared by reaction of an alkaline earth metal silicate such as calcium silicate with aluminum sulfate in an aqueous medium initially containing an alkaline earth metal sulfate such as calcium sulfate. Paper of high whiteness and brightness is prepared by adding to a slurry of paper forming fibers a quantity of aluminum sulfate and, after the aluminum sulfate solution has permeated the pores of the slurry, adding a quantity of calcium silicate. Additionally, U.S. Pat. No. 2,888,377, the disclosure of which is totally incorporated herein by reference, discloses a process for producing calcium silicate, which can be used as an opacifier, reinforcing pigment, or loading agent for paper. Further, U.S. Pat. No. 2,919,222, the disclosure of which is totally incorporated herein by reference, discloses a process for making paper wherein finely divided, hydrated calcium silicate pigment is added to a furnish comprising pulp, sizing material, filler, and other ingredients to form paper containing the pigment.

U.S. Pat. No. 4,636,410, the disclosure of which is totally incorporated herein by reference, discloses the preparation of various pigmented coating formulations used for producing highly absorbent recording papers. Additionally, U.S. Pat. No. 4,440,827, the disclosure of which is totally incorporated herein by reference, discloses coatings based upon highly absorbent inorganic pigments dispersed in various aqueous organic binder systems. U.S. Pat. No. 4,478,910, the disclosure of which is totally incorporated herein by reference, describes the application of various high surface area pigment-based formulations to base papers with a specific degree of hydrophobic sizing, to produce highly absorbent recording papers with more plain-paper like tactile properties. In addition, U.S. Pat. No. 4,734,336, the disclosure of which is totally incorporated herein by reference, discloses the preparation of highly absorbent papers based on a multi-ply structure, whereby the outer-ply incorporates various concentrations of highly absorbent oleophilic pigments.

In addition, the incorporation of oil absorbent pigments in carbonless papers is known. For example, U.S. Pat. No. 4,154,462, the disclosure of which is totally incorporated herein by reference, discloses a transfer sheet having a substrate coated with pressure-rupturable microcapsules containing an oil and an oil-soluble dye intermediate and a particulate oil-absorptive material which is non-reactive with the dye intermediate and is situated with respect to the microcapsules such that oil released by the microcapsules is absorbed thereby. The concentration of oil absorptive material is sufficient to permit writing on the coated substrate without interference from oil released by ruptured microcapsules but less than that which materially reduces the transfer of oily solution from ruptured microcapsules to an underlying copy sheet. Also, U.S. Pat. No. 3,481,759, the disclosure of which is totally incorporated herein by reference, discloses self-marking papers of the transfer or manifolding type that operate by having a dye precursor within microscopic capsules carried as a transfer coating on one sheet of paper, the dye precursor within the capsules reacting with a receptor coating on a mating sheet of paper to produce a visible mark on the mating sheet upon impact against the contacting transfer and receptor coatings when the two sheets of paper are mated, the microcapsules at the point of impact rupturing and releasing their contents onto the receptor coating of the mating sheet. To prevent the inadvertent marking or backgrounding during handling, a co-reactant for the dye precursor is included in the transfer coating containing the capsules but externally of the capsules so that upon the inadvertent rupture of capsules in the transfer coating the contents will react with the colorless co-reactant before passage through the sheet or transfer to the receptor sheet coating, and thus prevent inadvertent marking of the paper. Scuff capsules to help further prevent inadvertent marking may also be included in the transfer coating along with the dye precursor containing capsules. Further, U.S. Pat. No. 4,089,547, the disclosure of which is totally incorporated herein by reference, discloses manifold receptor sheets for use with conventional donor sheets, the receptor sheet comprising a substrate having deposited thereon a coating comprising hydrophobic fumed silicon dioxide, together with processes for producing such receptor sheets. The reference discloses a carbonless color developer coating consisting of very small particles (7 to 14 nanometers in diameter) of hydrophobic fumed silicon dioxide and a suitable binder. The particles of silicon dioxide have a surface area of from 200 to 400 square meters per gram.

Of additional background interest are U.S. Pat. No. 2,929,736, which discloses a heat and pressure responsive record material in which a microencapsulated color former solution and a color developing pigment are combined in a single coating; U.S. Pat. No. 2,980,941, which discloses a soil-removing sheet consisting of encapsulated soil-removing solvent along with an absorptive material such as Fuller's earth; and U.S. Pat. No. 3,776,864, which discloses a transfer ink containing a dye and a filler to prevent the coating from having a greasy surface.

U.S. Pat. No. 4,554,181 discloses an ink jet recording sheet having a recording surface which includes a combination of a water soluble polyvalent metal salt and a cationic polymer, said polymer having cationic groups which are available in the recording surface for insolubilizing an anionic dye. The recording surface may be formed by applying an aqueous solution of the aforesaid salt and polymer to the surface of an absorbent sheet material such as paper or by applying a coating containing the polymer and salt combination alone or in combination with a binder to the surface of a substrate.

In addition, U.S. Pat. No. 4,792,487 discloses an ink jet printing substrate particularly useful as a coating for multi-color, water base ink jet printing. The substrate consists essentially of a high swelling montmorillonite clay and optionally includes a high surface area pigment such as synthetic silica or calcium carbonate and a water-insoluble binder.

Further, U.S. Pat. No. 4,778,711 discloses an electrophotographic image transfer paper for a copier including a fixing operation which comprises a sheet of raw paper and a receiving layer on the paper for reducing blistering of the sheet during fixing of an image on the sheet. The receiving layer includes a coating on at least one side of the sheet having a center-line-average surface roughness of not more than 2.0 micrometers and an air permeability less than or equal to 4,000 seconds. The coating comprises water soluble adhesives and pigments that have small particle sizes and high levels of oil absorption.

Copending application U.S. Ser. No. 07/616,971, the disclosure of which is totally incorporated herein by reference, discloses a process for generating images which comprises incorporating into an ink jet printing apparatus a carbonless paper set which comprises a first sheet comprising a support containing a color developer capable of reacting with a color former to produce a color image, said color developer comprising high surface area silica particles, and a second sheet comprising a support coated with the color former, forming an image on the first sheet by causing ink to be expelled in droplets on the surface containing the color developer, and forming an image on the second sheet by causing ink to be expelled in droplets onto the surface opposite to that coated with the color former.

Although the known compositions and processes are suitable for their intended purposes, a need remains for a carbonless paper that is suitable for use in electrophotographic printers, copiers, and duplicators. In addition, a need exist for carbonless paper that will not contaminate imaging members in printers, copiers, and duplicators. Further, there is a need for carbonless paper that enables removal of residual coating materials from various components of an imaging device as it passes through the device. Further, there is a need for carbonless paper that enables removal of residual coating materials from pressure nips in various mechanical devices incorporating automated paper handling systems. Additionally, a need remains for a process of generating images on the sheets of a carbonless paper set wherein residual coating material from the coated sheets is periodically removed from components of the imaging device that contact the coated sheets. There is also a need for carbonless paper that is compatible with imaging apparatuses employing bias transfer rollers.

SUMMARY OF THE INVENTION

It is an object of the present invention to provide a carbonless paper that is suitable for use in electrophotographic printers, copiers, and duplicators.

It is another object of the present invention to provide carbonless paper that will not contaminate imaging members in printers, copiers, and duplicators.

It is yet another object of the present invention to provide carbonless paper that enables removal of residual coating materials from various components of an imaging device as it passes through the device.

It is still another object of the present invention to provide carbonless paper that enables removal of residual coating material from various components of other mechanical devices that incorporate automated paper handling systems.

Another object of the present invention is to provide a process of generating images on the sheets of a carbonless paper set wherein residual coating material from the coated sheets is periodically removed from components of the imaging device that contact the coated sheets.

Yet another object of the present invention is to provide carbonless paper that is compatible with imaging apparatuses employing bias transfer rollers.

These and other objects of the present invention (or specific embodiments thereof) can be achieved by providing a carbonless paper set having at least two sheets, wherein a first sheet comprises paper coated on one surface with a color former and a second sheet comprises paper coated on one surface with a color developer, and wherein at least one of the sheets contains an oleophilic pigment on the surface of the sheet opposite to the coated with the color former or color developer. In another embodiment of the invention, both sheets contain an oleophilic pigment filler material on the surface opposite to that coated with the color former or color developer. In yet another embodiment of the invention, the carbonless paper set also contains one or more intermediate sheets comprising paper coated on one surface with a color developer and coated on the opposite surface with a color former. In still another embodiment of the invention, the carbonless paper set comprises a first sheet of paper and a second sheet of paper, said second sheet being coated on one surface with both a color former and a color developer, wherein at least one of the sheets contains an oleophilic pigment filler material contained within the paper fibers and/or coated on the surface. When the sheet coated with the color former and color developer is also coated with the oleophilic pigment filler material, the pigment coating is on the surface of the sheet opposite to the surface with color former and color developer coatings. One specific embodiment of the present invention is directed to a carbonless paper set which comprises a first sheet comprising a first paper support comprising paper fibers, said first paper support being coated with a color former, and a second sheet comprising a second paper support comprising paper fibers, said second paper support being coated with a color developer, wherein at least one of the paper supports contains an oleophilic pigment filler material within the paper fibers. Another specific embodiment of the present invention is directed to a carbonless paper set which comprises a first sheet comprising a first paper support comprising paper fibers, said first paper support being coated with a color former, and a second sheet comprising a second paper support comprising paper fibers, said second paper support being coated with a color developer, wherein at least one of the paper supports contains an oleophilic pigment filler material coated onto the surface of the support opposite to the surface coated with the color former or color developer.

Another embodiment of the present invention is directed to a process which comprises providing a carbonless paper set having at least two sheets, wherein a first sheet comprises paper coated on one with a color former and a second sheet comprises paper coated on one surface with a color developer, and wherein at least one of the sheets contains an oleophilic pigment on the surface of the sheet opposite to that coated with the color former or color developer, and sequentially passing the first and second sheets through a pressure nip. In a specific embodiment of this process, both sheets contain an oleophilic pigment filler material. In another specific embodiment of this process, the carbonless paper set also contains one or more intermediate sheets comprising paper coated on one surface with a color developer and coated on the opposite surface with a color former.

Still another embodiment of the present invention resides in a process for generating images which comprises generating an electrostatic latent image on an imaging member in an imaging apparatus, developing the latent image with toner particles of one polarity, contacting the developed image on the imaging member with the first sheet of the carbonless paper set of the present invention, passing the first sheet through a nip formed by the imaging member and a bias transfer roll in contact with the imaging member and charged to a polarity opposite to that of the toner particles, thereby transferring the developed image to the first sheet, generating an electrostatic latent image on the imaging member in the imaging apparatus, developing the latent image with toner particles of one polarity, contacting the developed image on the imaging member with the second sheet of the carbonless paper set of the present invention, passing the second sheet through a nip formed by the imaging member and a bias transfer roll in contact with the imaging member and charged to a polarity opposite to that of the toner particles, thereby transferring the developed image to the second sheet, and optionally permanently affixing the transferred images to the first and second sheets. Another embodiment of this process entails forming images and transferring them to intermediate sheets of carbonless paper after imaging the first sheet and prior to imaging the second sheet.

DETAILED DESCRIPTION OF THE INVENTION

Figure 1:
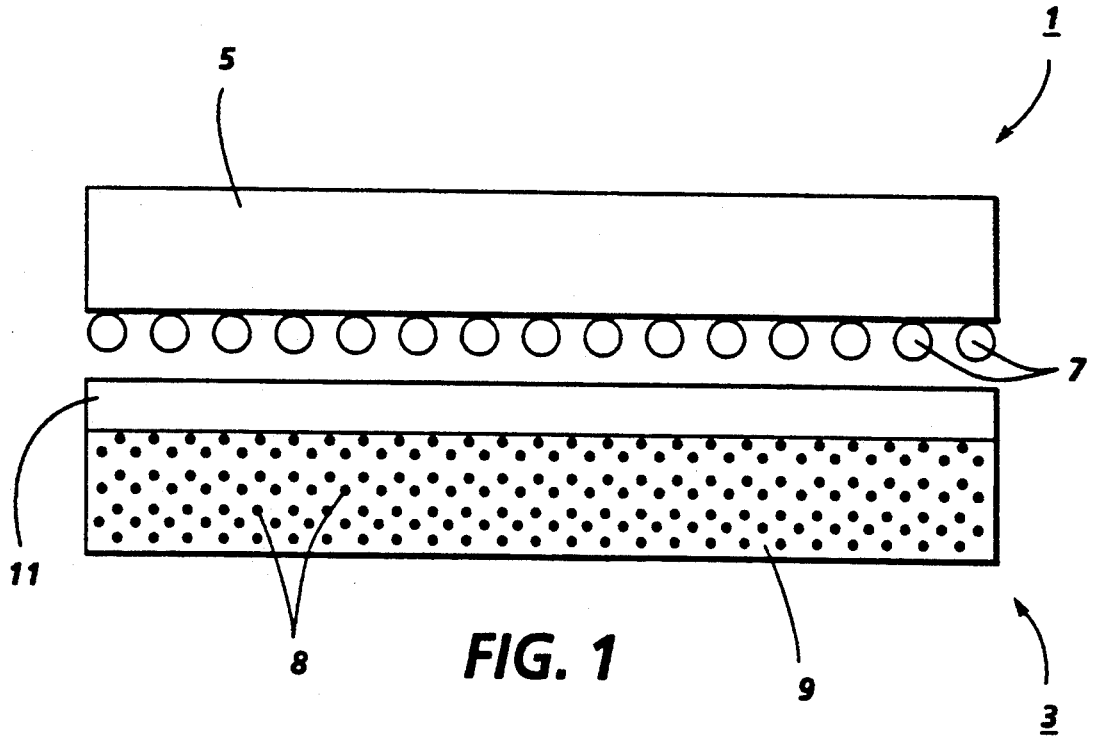
FIG. 1 illustrates schematically in cross-section an embodiment of the present invention wherein a carbonless paper set comprises a first sheet and a second sheet.

Illustrated in FIG. 1 is a carbonless paper set according to the present invention. The set comprises first sheet 1 and second sheet 3. First sheet 1 compirses a first base sheet of paper 5 and a color former coating comprising microcapsules 7 of a polycondensation emulsion polymerization process containing a colorless basic dye precursor or an organic complexing agent dissolved in a solvent oil and dispersed in a synthetic or natural product coating binder system. Second sheet 3 comprises a second base sheet of paper 9 and a color developer coating 11. As indicated, the surface of first sheet 1 containing color former coating 7 is in contact with the surface of second sheet 3 containing color developer coating 11. Base sheet of paper 9 of second sheet 3 contains an oleophilic pigment filler material 8 dispersed in the fibers of the paper. Optionally (not shown), base sheet of paper 5 of first sheet 1 also contains either in its fibers or in a coating an oleophilic pigment material. If coated, the optional oleophilic pigment coating is situated on the surface of base sheet 5 opposite to that bearing color former coating 7. Application of pressure in imagewise fashion to the surface of first sheet 1 on the surface opposite to that containing color former coating 7 results in rupture of the microcapsules in color former coating 7 and subsequent reaction of the dye precursor contained in the microcapsules with color developer coating 11 to form a colored image on the surface of second sheet 3 coated with color developer 11 in imagewise fashion where the pressure was applied.

Figure 2:
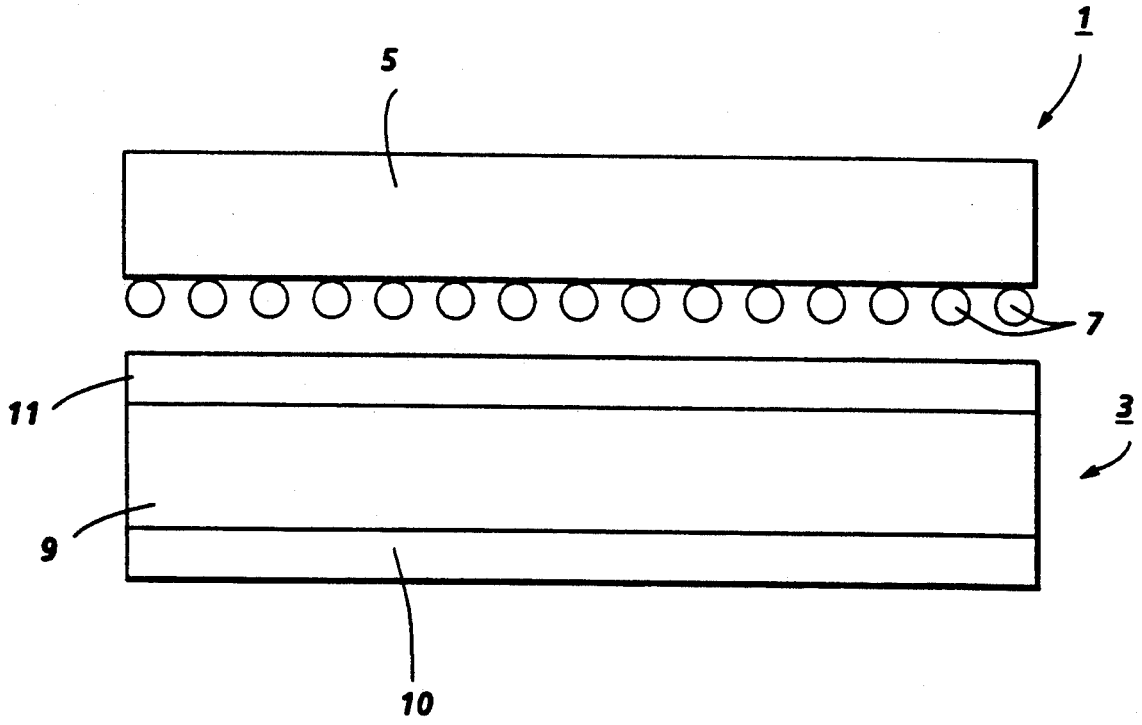
FIG. 2 illustrates schematically in cross-section another embodiment of the present invention wherein a carbonless paper set comprises a first sheet and a second sheet.

Illustrated in FIG. 2 is another carbonless paper set according to the present invnetion. The set comprises first sheet 1 and second sheet 3. First sheet 1 comprises a first base sheet of paper 5 and a color former coating comprising microcapsules 7 of a polycondensation emulsion polymerization process containing a colorless basic dye precursor or an organic complexing agent dissolved in a solvent oil and dispersed in a synthetic or natural product coating binder system. Second sheet 3 comprises a second base sheet of paper 9 and a color developer coating 11. As indicated, the surface of first sheet 1 containing color former coating 7 is in contact with the surface of second sheet 3 containing color developer coating 11. Base sheet of paper 9 of second sheet 3 has a coating 10 containing an oleophilic pigment filler material on the surface of the paper opposite to the surface coated with color developer 11. Optionally (not shown), base sheet of paper 5 of first sheet 1 also contains either in its fibers or in a coating an oleophilic pigment material. If coated, the optional oleophilic pigment coating is situated on the surface of base sheet 5 opposite to that bearing color former coating 7. Application of pressure in imagewise fashion to the surface of first sheet 1 on the surface opposite to that containing color former coating 7 results in rupture of the microcapsules in color former coating 7 and subsequent reaction of the dye precursor contained in the microcapsules with color developer coating 11 to form a colored image on the surface of second sheet 3 coated with color developer 11 in imagewise fashion where the pressure was applied.

Figure 3:
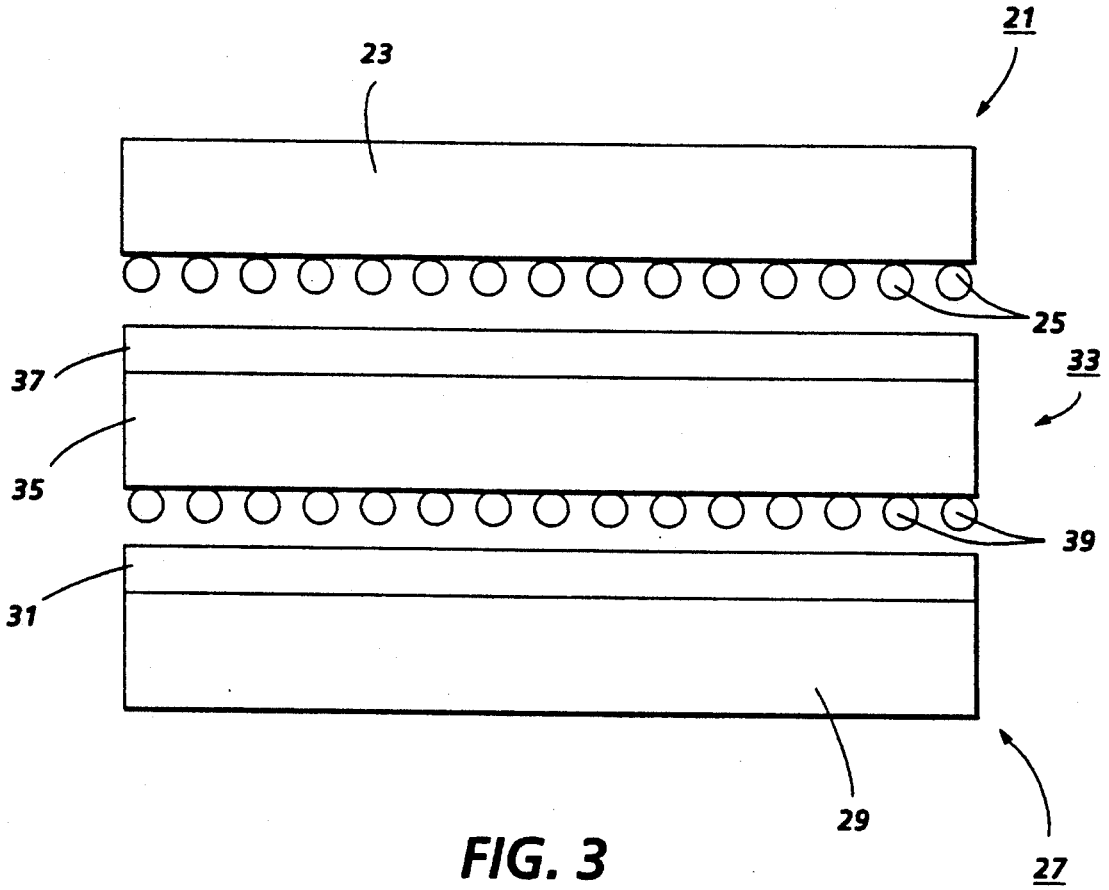
FIG. 3 illustrates schematically in cross-section an embodiment of the present invention wherein a carbonless paper set comprises a first sheet, a second sheet, and at least one intermediate sheet.

Illustrated in FIG. 3 is another carbonless paper set of the present invention. The set comprises first sheet 21, which comprises first base sheet of paper 23 coated with a color former coating 25, second sheet 27, which comprises second base sheet of paper 29 coated with a color developer coating 31, and intermediate sheet 33, which comprises intermediate base sheet of paper 35 coated with a color developer coating 37 and a color former coating 39. As indicated, when the paper set is collated for carbonless printing, the surface of first sheet 21 containing color former coating 25 is in contact with the surface of intermediate sheet 33 containing color developer coating 37, and the surface of intermediate sheet 33 containing color former coating 39 is in contact with the surface of second sheet 27 containing color developer coating 31. Base sheet of paper 29 of second sheet 27 contains an olephilic pigment filler material either dispersed in the fibers of the paper (as illustrated in FIG. 1) or coated onto the surface opposite to that coated with color developer coating 31 (as illustrated in FIG. 2). Optionally, base sheet of paper 23 of first sheet 21 also contains, either as a coating or dispersed within its fibers, an oleophilic pigment material. If coated, the optional oleophilic pigment is situated on the surface of base sheet 23 opposite to that bearing color former coating 25. Application of pressure in imagewise fashion to the surface of first sheet 21 on the surface opposite to that containing color former coating 25 results in rupture of the microcapsules in color former coatings 25 and 39 and subsequent reaction of the dye precursor contained in the microcapsules with color developer coatings 37 and 31, respectively, to form colored images on second sheet 27 and intermediate sheet 33 in imagewise fashion where pressure was applied.

Figure 4:
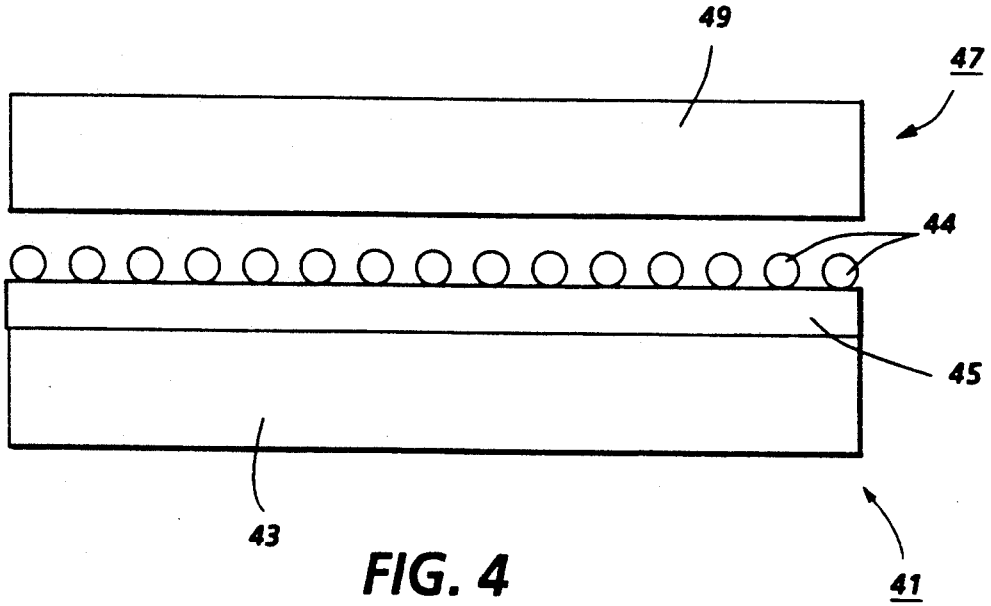
FIG. 4 illustrates schematically in cross-section another embodiment of the present invention wherein a carbonless paper set comprises a first sheet and a second sheet.

Illustrated in FIG. 4 is another carbonless paper set of the present invention. The set comprises first sheet 47, which comprises first base sheet of paper 49. Second sheet 41 comprises second base sheet of paper 43 containing both a color former coating 44 and a color developer coating 45. Second sheet 41 or first sheet 47 or both sheets contain an oleophilic pigment filler material either dispersed in the fibers (as illustrated in FIG. 1) of the base paper or coated onto the surface (as illustrated in FIG. 2); when second sheet 41 contains the oleophilic pigment filler material as a coating, the coating is situated on the surface of second base sheet 43 opposite to that containing the color former 44 and the color developer 45. Application of pressure in imagewise fashion to either sheet when the color former and color developer of sheet 41 are in contact with base sheet 49 results in rupture of the microcapsules of color former 44 and subsequent reaction of the dye precursor contained in the microcapsules with the color developer 45 to form colored images on second sheet 41 in imagewise fashion where pressure was applied.

Figure 5A:
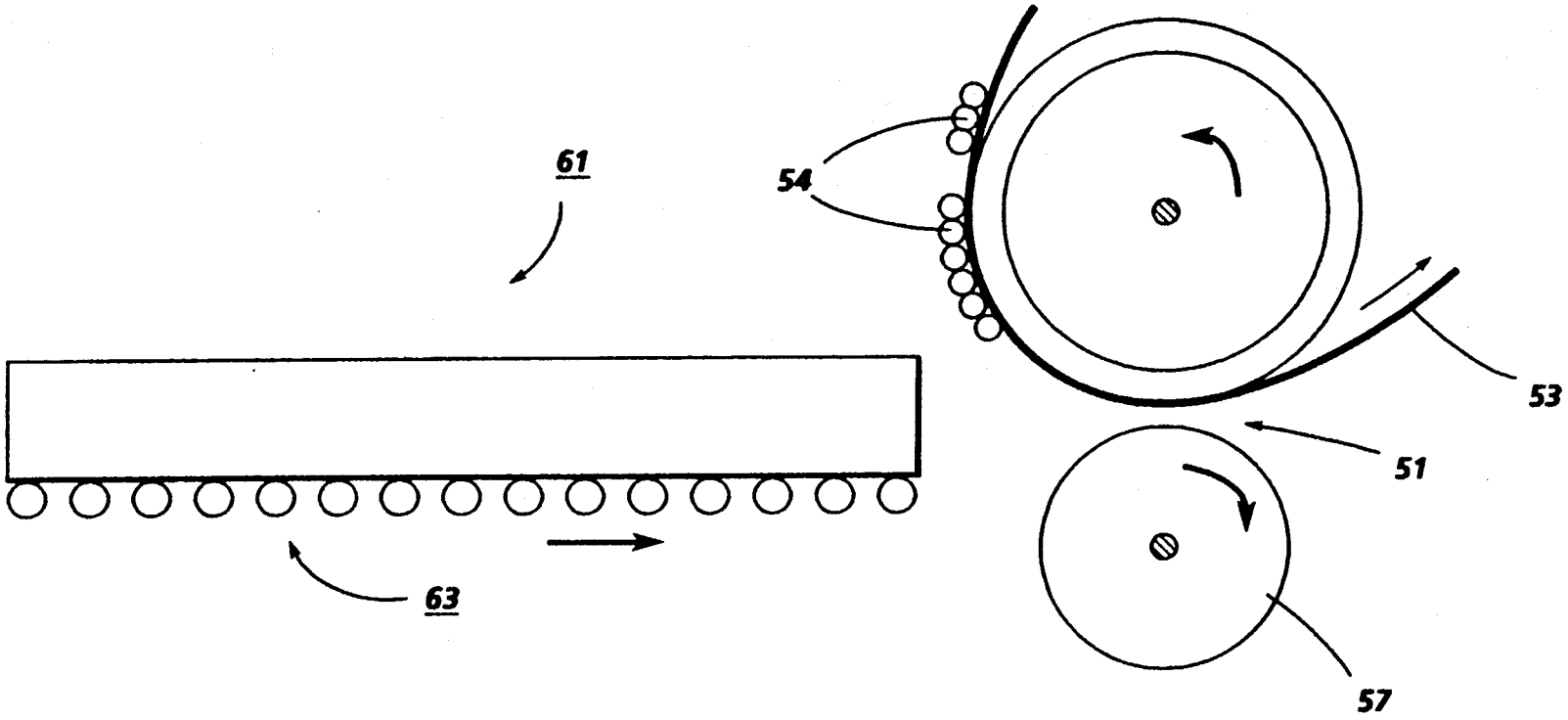
FIGS. 5*a*, 5*b*, and 5*c* illustrate schematically a portion of a process of the present invention, wherein the sheets of a carbonless paper set are sequentially passed through a nip formed between an imaging member and a bias transfer roll in an imaging apparatus.
Figure 5B:
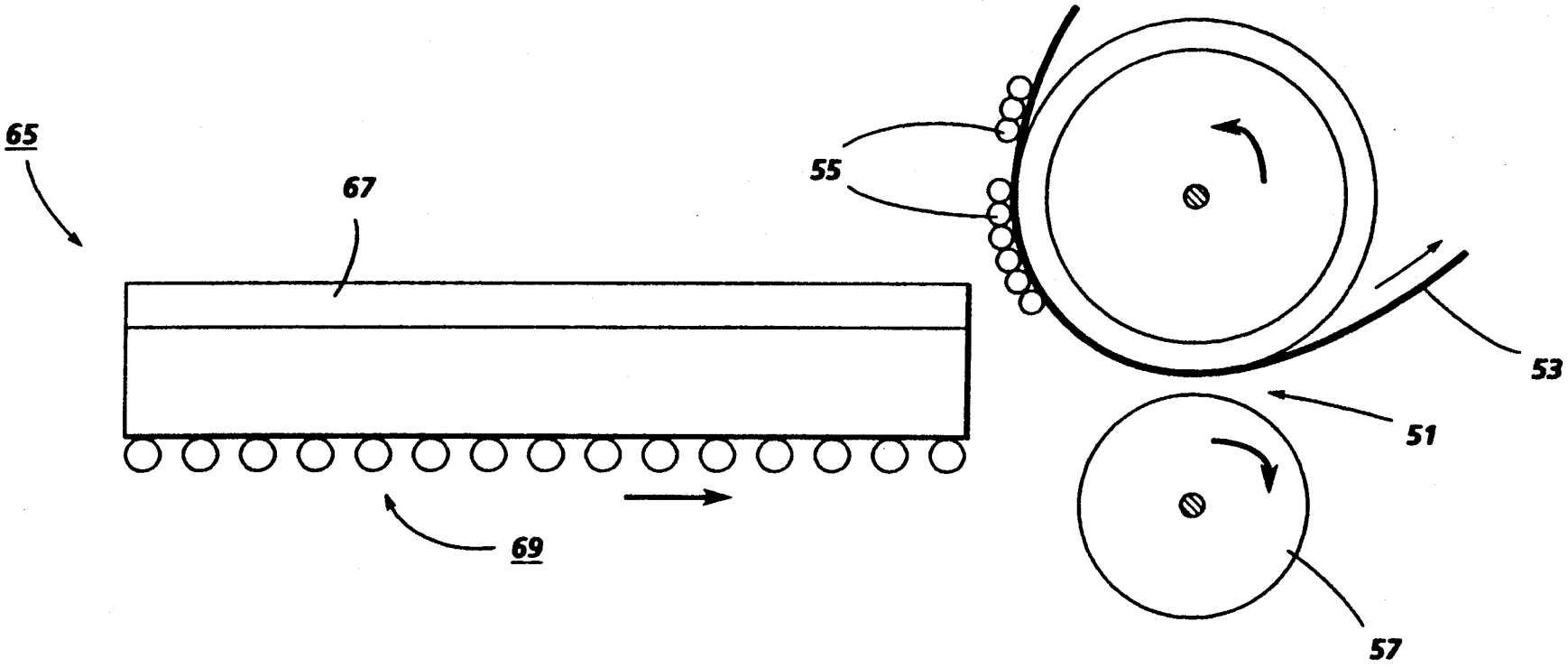
Figure 5C:
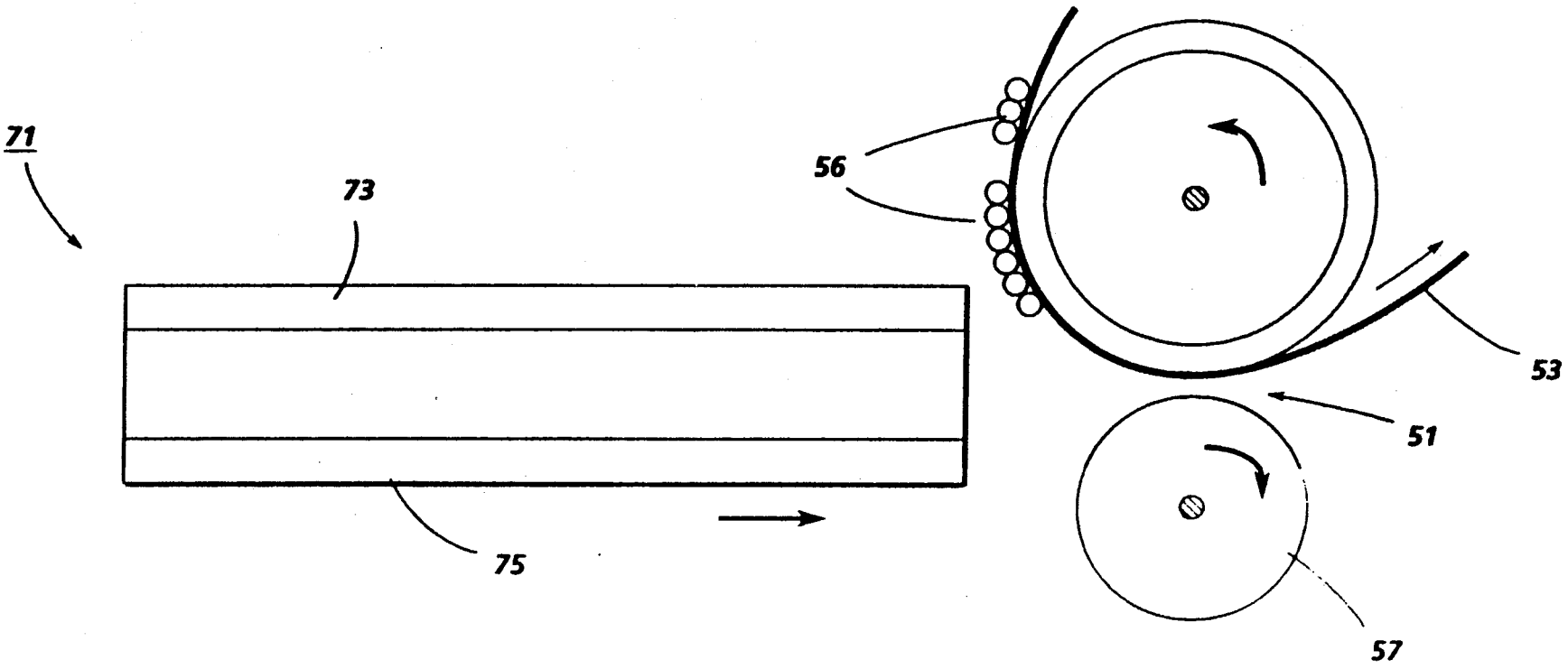

Illustrated in FIGS. 5*a*, 5*b*, and 5*c* is a portion of a process of the present invention, wherein the sheets of a carbonless paper set of the present invention are sequentially passed through a nip formed between an imaging member and a bias transfer roll in an imaging apparatus. In FIGS. 5*a*, 5*b*, and 5*c*, a sheet from the carbonless paper set passes through nip 51 formed by intimate contact between imaging member 53 bearing the image developed with toner particles 54, 55, or 56 and bias transfer roll 57. Bias transfer roll 57 is charged to a polarity opposite to that of toner particles 54, 55, or 56. When a sheet of paper passes through nip 51, the electrical potential on bias transfer roll 57 attracts toner particles 54, 55, or 56 from imaging member 53 to the paper sheet, thereby effecting transfer of the developed image to the paper.

In this embodiment of the invention, the carbonless paper set comprises a top sheet 61 coated on its bottom surface with a color former coating 63 comprising microcapsules of a color former material dissolved in a solvent, a middle sheet 65 coated on its top surface with a color developer coating 67 and on its bottom surface with color former coating 69 comprising microcapsules of a color former material dissolved in a solvent, and a bottom sheet 71 coated on its top surface with a color developer coating 73. As shown in this embodiment, the bottom sheet 71 is coated on its bottom surface with a coating of an oleophilic pigment filler 75. Optionally, instead of coating bottom sheet 71 with a coating of the pigment, the oleophilic pigment filler can be incorporated into the paper fibers of the bottom sheet 71.

As shown in FIG. 5*a*, top sheet 61 passes through nip 51 between imaging member 53 and bias transfer roll 57. Toner particles 54 are attracted from imaging member 53 to top sheet 61 as a result of the bias on bias transfer roll 57. Color former coating 63 contacts bias transfer roll 57, resulting in rupture of some of the microcapsules and transfer of oil contained in the microcapsules to bias transfer roll 57. After transfer of the developed image to top sheet 61, imaging member 53 comes into intimate contact with bias transfer roll 57. Subsequently, as shown in FIG. 5*b*, middle sheet 65 passes through nip 51 between imaging member 53 and bias transfer roll 57. Toner particles 55 are attracted from imaging member 53 to middle sheet 65 as a result of the bias on bias transfer roll 57. Color former coating 69 contacts bias transfer roll 57, resulting in rupture of some of the microcapsules and transfer of oil contained in the microcapsules to bias transfer roll 57. After transfer of the developed image to middle sheet 65, imaging member 53 comes into intimate contact with bias transfer roll 57. Thereafter, as shown in FIG. 5*c*, bottom sheet 71 passes through nip 51 between imaging member 53 and bias transfer roll 57. Toner particles 56 are attracted from imaging member 53 to bottom sheet 71 as a result of the bias on bias transfer roll 57. Oleophilic pigment filler coating 75 on bottom sheet 71 contacts bias transfer roll 57, resulting in absorption into the pigment filler layer 75 of oil previously transferred to the bias transfer roll 57 from the microcapsules in color former layers 63 and 69.

As indicated, bias transfer roll 57 and imaging member 53 contact each other before and after each sheet passes through nip 51. Oil contained on the surface of bias transfer roll 57 can be transferred to imaging member 53 during these periods of contact. Absorption of the oil on bias transfer roll 57 by the third or bottom sheet 71 of the carbonless paper set periodically cleans the bias transfer roll of oil and reduces or eliminates the oil that would otherwise be transferred to imaging member 53 and subsequently cause formation of tackified toner deposits. Optionally, top sheet 61 can either be coated on its top surface with a coating of an oleophilic pigment filler or can contain in its paper fibers an oleophilic pigment filler. In this instance, imaging member 53 is also cleaned periodically by contact with top sheet 61, thereby further reducing or eliminating any oil on imaging member 53 that would otherwise cause formation of tackified toner deposits.

A similar process occurs in other pressure nips in the electrophotographic imaging device, such as those formed by the paper feed and retard belts, various sets of paper pinch rollers, or the two fuser rolls. Similar processes also occur in pressure nips in other mechanical devices with automated paper handling systems. In general, as the first sheet in a carbonless set passes through a pressure nip, the color forming coating contacts the lower pressure element, resulting in rupture of some of the microcapsules and transfer of oil contained in the microcapsules to the lower pressure element. After the first carbonless sheet has passed through the nip, the upper pressure element comes into contact with the lower element, causing some of the carbonless oil to transfer from the lower to the upper element. If the carbonless oil is not removed from the pressure nip, it may interact with the materials of the upper or lower pressure elements, or with other components of subsequent carbonless sheets, or with components of other subsequent throughput materials to cause contamination of the pressure nip, which may have a deleterious effect on the continued operation of the device.

Subsequently, however, with carbonless paper sets of the present invention the second sheet in the carbonless set passes through the pressure nip such that the oleophilic pigment filler dispersed in or coated on the base paper of the second carbonless sheet comes into contact with the lower pressure element, resulting in absorption by the pigment filler of oil previously transferred to the lower element from the color former layer of the first carbonless sheet. Absorption of oil by the second carbonless sheet periodically cleans the lower pressure element of oil and reduces or eliminates oil that would otherwise transfer to the upper pressure element. Optionally, the base paper of the first crrbonless sheet may also have an oleophilic pigment filler either coated on its top surface or dispersed in the base paper, such that the upper pressure element is also periodically cleaned by contact with the first carbonless sheet, thereby further reducing or eliminating any carbonless oil that could otherwise cause contamination of the pressure nip.

The carbonless paper sets of the present invention comprise at least two support sheets of base paper, each of which contains on one surface either a color former or a color developer. Alternatively, both the color former and the color developer can be contained on the surface of one of the sheets. Optional intermediate sheets contain on one surface a color former and on the other surface a color developer. The supporting base paper may comprise pulp fibers and blends thereof originating from bleached hardwood and softwood fibers, bleached mechanical pulp fibers, cotton fibers, and synthetic fibers. More specifically, examples of suitable cellulosic pulps include Domtar Seagul W and Q90, a 75/25 percent bleached hardwood and softwood blend of fibers, and 100% bleached groundwood pulp (Acadia Forest Products Ltd.). For those familiar with the art of papermaking, formed sheets derived from cellulosic pulps should be suitably sized so as to minimize penetration of subsequent coating material. Internal and surface sizing treatments include, for example, rosin acid/alum, alkyl ketene dimer, starch, and/or various synthetic polymers.

The color formers generally comprise a binder plus microcapsules containing a color forming material dissolved in a suitable solvent. In general, the color forming material can be either a substantially colorless basic dye precursor, or an organic complexing agent, or a combination of the two. The color forming material may be a colorless basic dye precursor such as, for example, benzoyl leuco methylene blue; diaryl phthalides such as 3,3-bis (4-dimethylaminophenyl)-6-dimethylaminophthalide (Crystal Violet Lactone) and 3,3-bis (4-dimethylaminophenyl) phthalide (Malachite Green Lactone); other phenyl-, indolpyrrol-, and carbazol- substituted phthalides; leucauramines; acyl auramines; unsaturated aryl ketones; basic mono azo dyes; Rhodamine B Lactams; polyaryl carbinols; nitro-, amino-, amido-, sulfon amido-, aminobenzylidene-, halo-, and anilino- substituted fluorans, such as 3-diethylamino-6-methyl-7-anilinofluoran; spirodipyrans; pyridine and pyrazine compounds; or the like. Examples of a colorless basic dye precursor are disclosed in U.S. Pat. No. 2,417,897, U.S. Pat. No. 3,672,936 U.S. Pat. No. 3,681,390, U.S. Pat. No. 4,202,820, and U.S. Pat. No. 4,675,706, the disclosures of each of which are totally incorporated herein by reference. The color forming material may also be an organic complexing agent. Examples of organic complexing agents include those listed in U.S. Pat. No. 3,481,759, U.S. Pat. No. 4,334,015, and U.S. Pat. No. 4,372,582, the disclosures of each of which are totally incorporated herein by reference. Examples of organic complexing agents include dithiooxamide and its derivatives such as N,N'-dibenzyl-dithiooxamide, N,N'-bis(2-octanlyloxyethyl) dithiooxamide, and di-dodecyl dithiooxamide; aromatic substituted hydrazones such as those disclosed in U.S. Pat. No. 4,334,015, the disclosure of which is totally incorporated herein by reference; or the like.

Typically the chosen color former material, or combination of color former materials, is dissolved in a suitable organic solvent and encapsulated in a hard polymeric shell by one of several known encapsulation techniques. Examples of suitable solvents include alkyl biphenyls such as propylbiphenyl and butylbiphenyl; dialkyl phthalates such as diethylphthalate, dibutylphthalate, dioctylphthalate, dinonylphthalate, and ditridecylphthalate; alkylated naphthalenes such as dipropylnaphthalene; $C_{10}$–$C_{14}$ alkyl benzenes such as dodecyl benzene; alkyl or aralkyl benzoates such as benzyl benzoate; benzylxylene; benzylbutylphthalate; ethyldiphenylmethane; 2,2,4-trimethyl-1,3-pentanediol diisobutyrate; partially hydrogenated terphenyls; cyclohexane; toluene; 3-heptanone; tributyl phosphate; and mixtures of the above. The solvents for the color former can include any of the above which possess sufficient solubility for the color former. A suitable solvent should be capable of dissolving at least about 1 percent by weight and preferably from about 2 to about 10 percent by weight of the color former. In the case of a basic dye precursor/acidic polymer developer system, or an organic complexing agent/transition metal salt system, the color former solvent preferably is also a cosolvent for the color developer material to promote the color forming reaction. Of course, a suitable solvent must also be a non-solvent for the chosen microcapsule wall material.

Minute droplets of color former solution are produced by emulsifying the solvent oil in an aqueous medium. The color former solution droplets can then be encapsulated in a polymeric shell by any one of a number of known microencapsulation techniques, such as coacervation, complex coacervation, interfacial polymerization, in-situ polymerization, or the like. Methods for encapsulating minute droplets of color former solution in a polymeric shell are described in, for example, U.S. Pat. No. 2,800,457, U.S. Pat. No. 2,800,458, U.S. Pat. No. 3,418,250, and U.S. Pat. No. 3,516,941, the disclosures of each of which are totally incorporated herein by reference. Capsule wall forming materials include but are not limited to gelatin wall formers such as gum arabic, polyvinyl alcohol, and carboxymethylcellulose; isocyanate wall-formers; urea-formaldehyde and urea-resorcinol-formaldehyde; melamine-formaldehyde; polyurea; polyurethane; polyamide; polyester; and the like. The completed microcapsules are typically from about 1 to about 50 microns and preferably from about 5 to about 10 microns in diameter. The capsule fill of color former in solvent typically comprises from about 50 to about 95 percent of the total capsule weight.

A coating formulation is prepared by mixing an aqueous dispersion of microcapsules containing color former solution with an aqueous dispersion of a suitable binder, such as starch, polyvinyl alcohol, latex, or the like with a capsule:binder ratio typically being from about 9:1 to about 7:3. The capsule plus binder dispersion is then coated onto a paper support using any one of a number of known paper coating techniques, such as roll, gravure, air-knife, blade, rod, or slot die coating, although methods that minimize capsule breakage, such as roll and air-knife, are preferred.

Optionally, the color former coating can also include from about 5 to about 10 percent by weight of particles of somewhat larger size than the microcapsules. For example, as disclosed in U.S. Pat. No. 4,630,079, the disclosure of which is totally incorporated herein by reference, the color former coating contains particles of somewhat larger size than the microcapsules to prevent or reduce accidental or premature breakage of the microcapsules. Such particles typically comprise fine powders of cellulose, starch granules, or various types of plastic beads. The dry coat weights for the color former coating, which includes the capsule walls, the liquid capsule fill, the binder, and the spacer particles (if any) range from about 2 to 10 grams per square meter. Of this, about 1 to 5 grams per square meter are liquid capsule fill (mainly solvent), and of this about 0.1 to 1 gram per square meter is actually dissolved color former.

For a basic dye precursor color former, the corresponding color developer generally comprises an acidic developer material. Acidic color developers may be inorganic pigments such as acidic clay, active clay, attapulgite, zeolite, bentonite, kaolin, silicic acid, synthetic silicic acid, aluminum silicate, zinc silicate, and the like; organic acids such as tannic acid, gallic acid, benzoic acid, propyl gallate, and bisphenol-A; acidic polymers such as phenolic resins, including phenol-aldehyde polymers, phenol-acetylene polymers, and rosin maleate resin; aromatic carboxylic acids such as salicylic acid and its derivatives; metal salts of aromatic carboxylic acids such as zinc salicylate; zinc-chelated phenolic resins; oil soluble metal salts of phenol-formaldehyde resins; and combinations of the above. To produce the bottom sheet of a carbonless paper set, solid particles of the color developer material are mixed with a suitable binder such as latex, polyvinyl alcohol, starch, gum arabic, or other film-forming material, and coated on the top of a paper support. The acidic color developer material may also be mixed with neutral inorganic pigments such as various clays or calcium carbonate, along with a suitable binder to form the color developer coating. In the case of an inorganic acidic developer material, a coating formulation is prepared by mixing an aqueous dispersion of the acid clay with a suitable binder such as starch, polyvinyl alcohol, or latex, with a clay:binder ratio typically between about 9:1 and about 6:4. This mixture can be coated onto a paper support by any of a number of known techniques, including roll, gravure, air-knife, blade, slot die, or the like. In the case of an organic acidic color developer material, it may be dissolved or dispersed in a suitable organic solvent vehicle to form a printing ink that can be coated on a paper support by any of a number of known techniques. Alternately, the organic acidic developer material may be ground into fine particle form, to furnish a large reactant surface per unit area for the color former, and mixed in an aqueous dispersion with a suitable binder, with particle:binder ratios typically between about 9:1 and about 6:4, and coated on a paper support by any of a number of known techniques. Additionally, fine particles of organic acidic color developer may be mixed with a neutral inorganic pigment such as various clays or calcium carbonate to promote absorption of the color former solution, and dispersed in an aqueous medium with suitable binders, with typical acid resin:pigment:binder ratios of 15:75:10, and coated on a paper support by any of a number of known techniques. Acidic color developers are disclosed in, for example, U.S. Pat. No. 3,244,550, U.S. Pat. No. 3,672,935, U.S. Pat. No. 3,732,120, U.S. Pat. No. 3,843,383, and U.S. Pat. No. 3,934,070, the disclosures of each of which are totally incorporated herein by reference.

For an organic complexing agent color former, the corresponding color developer generally comprises a salt of a transition metal such as Ni, Cu, Co, or Zn. Examples of transition metal salts for color developers include nickel 2-ethylhexoate and nickel rosinate. A color developer sheet may be produced by adding to the initial paper pulp slurry a water soluble rosin salt such as sodium rosinate, along with a water soluble metal salt such as nickel sulfate, which causes an insoluble metal rosinate, i.e. nickel rosinate, to be precipitated as a sizing on the paper fibers. The treated fibers are then formed into a paper sheet by conventional papermaking techniques. Alternately, an aqueous dispersion of nickel rosinate may be coated on the surface of a paper support by any of a number of known techniques. Additionally, a transition metal salt such as nickel 2-ethylhexoate may be combined in an aqueous dispersion with an inorganic pigment such as various clays or aluminum oxide, along with suitable binders, and coated on a paper support by any of a number of known techniques. Transition metal color developers are disclosed in U.S. Pat. No. 3,481,759, U.S. Pat. No. 3,809,668, and U.S. Pat. No. 4,334,015, the disclosures of each of which are totally incorporated herein by reference. As disclosed in U.S. Pat. No. 4,372,582, the disclosure of which is totally incorporated herein by reference, if the microencapsulated color former is a combination of a basic dye precursor and an organic complexing agent, the appropriate color developer coating contains both an acidic developer material and a transition metal salt.

In all cases, the dry coat weight of the color developer coating typically ranges from about 1 to about 10 grams per square meter, which generally includes from about 0.5 to about 5 grams per square meter of color developer material. In general, there is typically an excess of color developer available to the color former material, or at least 5 to 10 grams of color developer per gram of color former.

One or more of the base paper supports of the carbonless paper set is either coated with or has contained in its fibers an oleophilic pigment filler. When a bias transfer roller is employed to transfer images to the carbonless paper set, preferably at least one of the sheets that contact the bias transfer roller during imaging of a carbonless set contains the oleophilic pigment. Coating onto a pre-formed paper is effected by means of applying a dispersion of a pigment in a water soluble natural product or synthetic polymeric binder. Suitable binder systems include, for example, starch, polyvinylalcohol, polyvinylpyrrolidone, styrene-vinylpyrrolidone copolymer, vinyl pyrrolidone-vinylacetate copolymer, styrene-maleic anhydride copolymer, and styrene-butadiene copolymers as well as mixtures thereof. Among pigments more specifically suited to the end-use application are synthetic amorphous silicas, inorganic oxides, inorganic silicates such as calcium silicate or sodium aluminosilicates, and attapulgas clay. These are characterized by pigment surface areas of from about 150 to about 400 square meters per gram and with oil absorption in the range of from about 100 to about 450 milliliters per gram. Incorporation of other more conventional paper coating pigments such as various clays or calcium carbonate may also be practised. Binder:pigment ratios in the range of from about 1:1 to about 1:10 and coat weights from about 3 to 20 grams per square meter are preferable. Suitable means of applying such coatings include, but are not necessarily restricted to: roll, gravure, air-knife, blade, rod and slot-die, respectively, employed in single or multiple applications.

Pigment may also be incorporated within the fibrous structure of the paper as a filler by means of: dispersion within the pulp stock prior to papermaking, resulting in bulk distribution of filler in single-ply forming, or surface distribution of filler in a multi-ply forming process; and size press application wherein the pigment is dispersed in a suitable water soluble natural product or synthetic polymeric binder. When the oleophilic pigment filler material is dispersed within the paper fibers, the pigment is typically present in the paper in an amount of from about 2 to about 30 percent by weight of the paper, although the amount can be outside of this range. Any oleophilic pigment filler suitable for use as a paper component or paper filler may be employed. Suitable oleophilic pigments include calcium silicate, available from Huber Corporation, sodium aluminum silicates, also available from Huber Corporation, and amorphous silicas, colloidal silicas, and fumed silicas, such as those available from Grace-Davison Company and Degussa AG.

The present invention is also directed to a process for generating images on the sheets of a carbonless paper set of the present invention. This process comprises generating an electrostatic latent image on an imaging member in an imaging apparatus, developing the latent image with toner particles charged to one polarity. The imaging apparatus may be any conventional imaging apparatus wherein an electrostatic latent image is formed and developed by a developer, including electrophotographic copiers, printers, and duplicators and ionographic apparatus as illustrated in, for example, U.S. Pat. No. 4,524,371 and U.S. Pat. No. 4,463,363, the disclosures of each of which are totally incorporated herein by reference. The imaging member may be charged either positively or negatively, and may be any imaging member suitable for electrophotographic or ionographic processes. Generally, the latent image can be developed with any single component or two component developer; negatively charged toners are generally employed with positively charging imaging members and positively charged toners are generally employed with negatively charging imaging members to obtain normal image development, whereas reverse image development can be obtained by developing the latent image with a toner charged to the same polarity as the latent image. Development can be by any suitable process, such as magnetic brush development, powder cloud development, cascade development, or the like.

Subsequent to development, the developed image is brought into contact with the first sheet of paper in the carbonless paper set and an electric charge is applied to the surface of the first carbonless sheet opposite the surface in contact with the imaging member by means of an ion deposition device such as a corotron, or by contacting the back surface of the first carbonless sheet with a bias transfer roll that is maintained at a voltage larger in magnitude and of the same polarity as the voltage of the latent image. When a negatively charged toner is employed, a positive charge is applied to the back surface of the sheet; when a positively charged toner is employed, a negative charge is applied to the back surface of the sheet. The charge applied to the back surface of the first carbonless sheet by the corotron or bias transfer roll attracts the toner particles to the paper, thereby effecting transfer of the image from the imaging member to the first carbonless sheet.

Additional latent images are generated and developed, and each is transferred to the additional sheets of paper in the carbonless paper set. The transferred images can optionally be permanently affixed to the paper by conventional methods, such as radiant fusing, cold pressure fusing, heat fusing, application of a combination of heat and pressure, solvent fusing, and the like.

Specific embodiments of the invention will now be described in detail. These examples are intended to be illustrative, and the invention is not limited to the materials, conditions, or process parameters set forth in these embodiments. All parts and percentages are by weight unless otherwise indicated. Operating conditions of the electrophotographic device are known to affect the rate of contamination of the imaging member. In the following examples, conditions were chosen to maximize the contamination rate in order to more easily measure the relative improvements in contamination rate produced by the various embodiments of the invention. Specifically, a used bias transfer roll was installed in the device, said bias transfer roll having previously been used for several thousand imaging cycles and as a result having a roughened surface more likely to rupture color former capsules on the carbonless paper than a new smooth-surfaced bias transfer roll. In addition, the pressure applied in the nip between the imaging member and the bias transfer roll was increased to near the maximum allowable value within the machine specifications. All modifications were within the standard acceptable operating specifications of the device.

EXAMPLE I

Figure 6A:
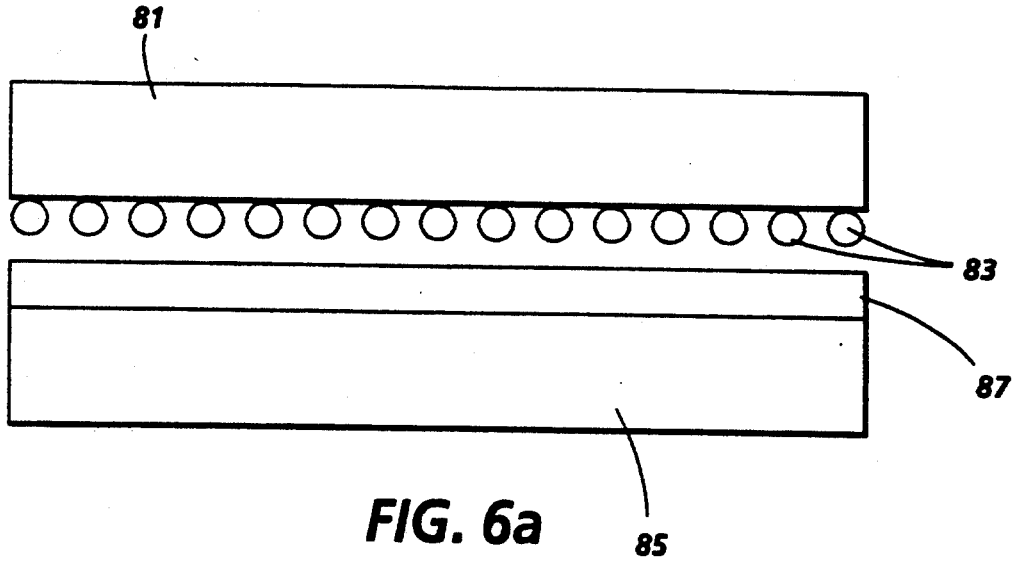
FIGS. 6*a*, 6*b*, and 6*c* illustrate schematically in cross-section the configurations of carbonless paper sets passed through a duplicating apparatus in the working examples herein.
Figure 7:
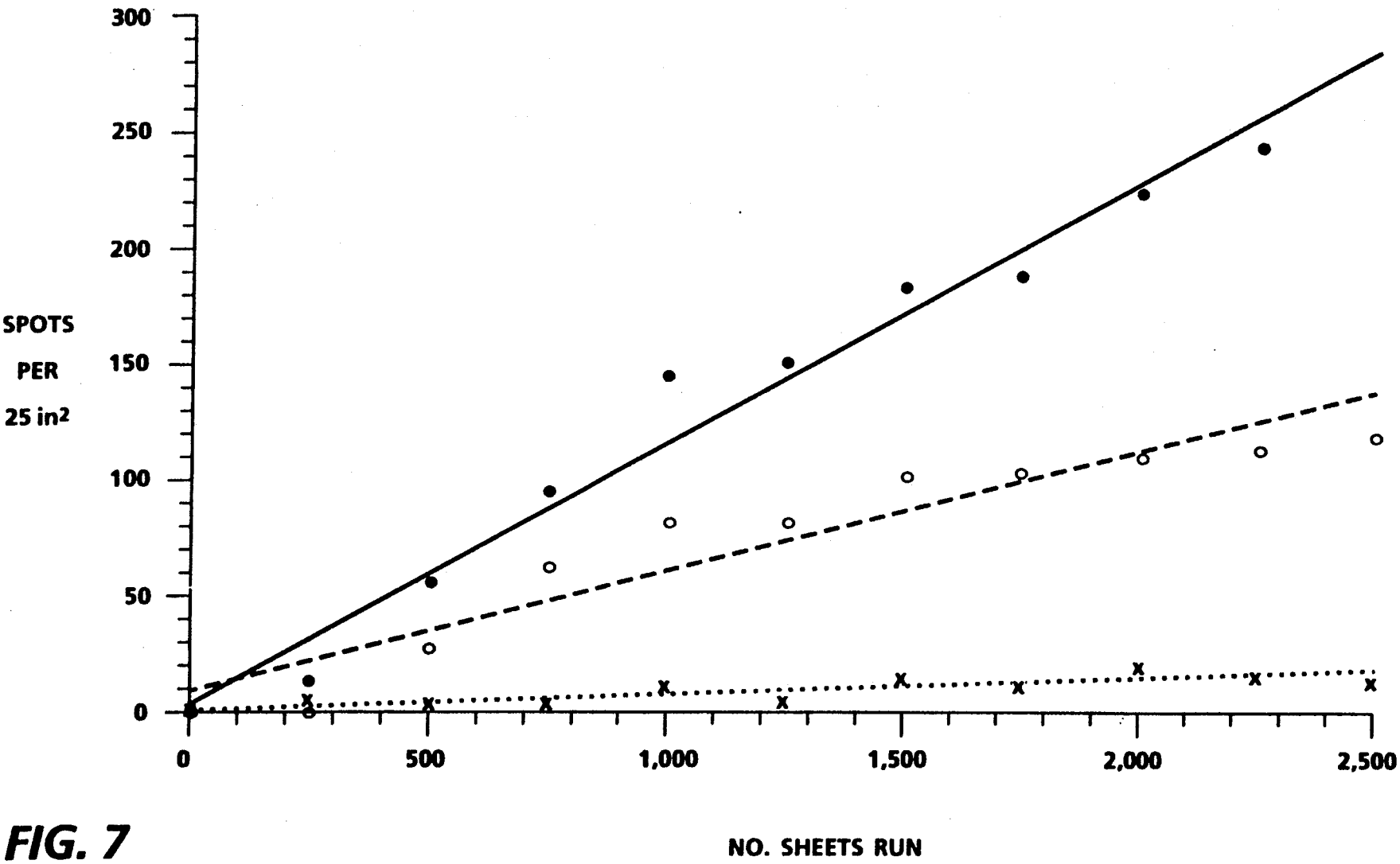
FIG. 7 illustrates in graph form the number of spots formed on an imaging member as a result of contamination from oil contained on carbonless paper sets under three series of conditions in the working examples herein.

Tartan® two-part carbonless paper sets available from Minnesota Mining and Manufacturing Company (3M) comprising a top sheet coated on the bottom surface with a color former layer and a bottom sheet coated on the top surface with a color developer layer were incorporated into the main paper tray of a Xerox® 9900 duplicator. Each set was oriented, as shown in FIG. 6*a*, so that the surface of the top sheet 81 coated with the color former layer 83 was in contact with the surface of the bottom sheet 85 coated with the color developer layer 87. 250 sheets (125 two-sheet sets) were then fed through the duplicator and imaged with a test pattern under conditions of 50 percent relative humidity so that the surface of each top sheet 81 containing the color former layer 83 was contacted by the bias transfer roller and the surface of the bottom sheet 85 coated with the color developer layer 87 did not contact the bias transfer roller. Subsequently, 14 sheets of Xerox® 4024 paper that had been placed in the auxiliary paper tray of the duplicator were imaged by exposing them to a sheet of blank white paper on the platen. This process was repeated with another 250 sheets (125 two-sheet sets) of the Tartan® two-part carbonless paper from the main tray and 14 sheets of Xerox® 4024 paper from the auxiliary paper tray, until 2500 sheets of the Tartan® carbonless paper and 140 sheets of the Xerox® 4024 paper had passed through the duplicator. Formation of toner deposits on the imaging member during this process was observed by determining the number of spots appearing on the 4024 sheets imaged by exposing them to blank white paper periodically during the process. The average number of spots observed on a "blank" 4024 sheet in a 3 inch wide, 25 square inch strip at the bottom of the sheet as a function of the number of carbonless sheets run is shown by the solid line and solid dots in FIG. 7. The individual data points, represented by solid dots, indicate the number of spots in the strip after each set of 250 carbonless sheets had been passed through the duplicator. The straight solid line represents a linear regression fit to the data points. As indicated, the number of spots observed rose rapidly with the number of carbonless paper sheets that passed through the duplicator, so that after 2500 sheets had been imaged, about 286 spots were observed in the 3 inch wide, 25 square inch strip at the bottom of the test pattern. At the conclusion of the test, the imaging member was carefully cleaned to remove all toner deposits.

EXAMPLE II

Figure 6B:
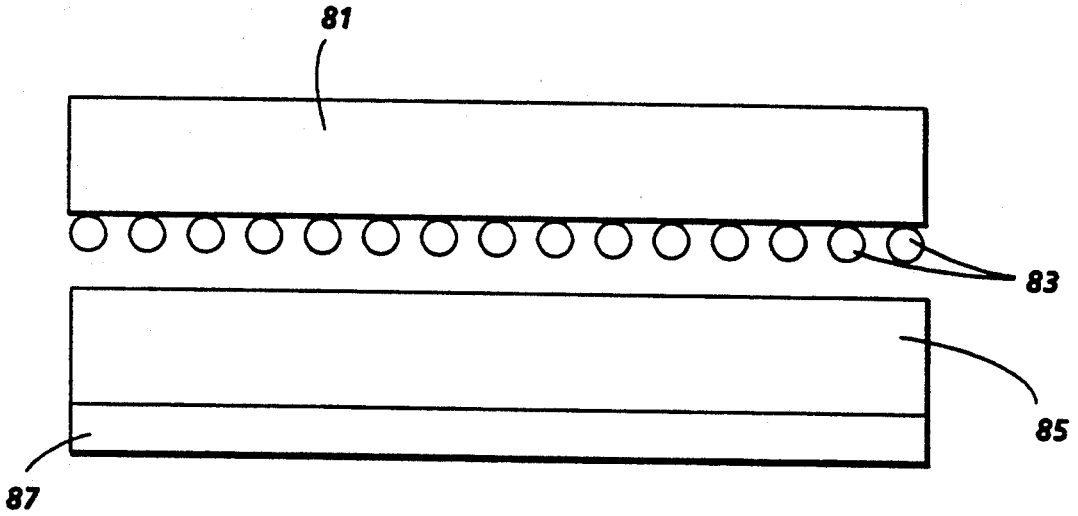

Tartan® two-part carbonless paper sets available from Minnesota Mining and Manufacturing Company (3M) comprising a top sheet coated on the bottom surface with a color former layer and a bottom sheet coated on the top surface with a color developer layer comprising a material capable of absorbing the oil in the color former capsules were disassembled and reassembled with the bottom sheet inverted, so that each set was oriented, as shown in FIG. 6*b*, with the surface of the top sheet 81 coated with the color former layer 83 being in contact with the surface of the bottom sheet 85 that was not coated with the color developer layer 87. 125 of these reassembled sets were then incorporated into the main paper tray of a Xerox® 9900 duplicator.

250 sheets (125 two-sheet sets) were fed through the duplicator and imaged with a test pattern under conditions of 50 percent relative humidity so that the surface of each top sheet 81 containing the color former layer 83 was contacted by the bias transfer roller and the surface of each bottom sheet 85 coated with the oleophilic clay plus alumina color developer layer 87 contacted the bias transfer roller. Subsequently, 14 sheets of Xerox ® 4024 paper that had been placed in the auxiliary paper tray of the duplicator were imaged by exposing them to a sheet of blank white paper on the platen. This process was repeated with another 250 sheets of Tartan ® two-part carbonless sets with inverted color developer sheets from the main tray and 14 sheets of Xerox ® 4024 paper from the auxiliary paper tray, until 2500 sheets of the Tartan ® carbonless paper and 140 sheets of the Xerox ® 4024 paper had passed through the duplicator. Formation of toner deposits on the imaging member during this process was observed by determining the number of spots appearing on the 4024 sheets imaged by exposing them to blank white paper periodically during the process. The average number of spots observed on a "blank" 4024 sheet in a 3 inch wide, 25 square inch strip at the bottom of the sheet as a function of the number of carbonless sheets run is shown by the dashed line and hollow dots in FIG. 7. The individual data points, represented by hollow dots, indicate the number of spots in the strip after each set of 250 carbonless sheets had been passed through the duplicator. The straight dashed line represents a linear regression fit to the data points. As indicated, the number of spots observed decreased significantly compared to the number observed when the carbonless paper sets were passed through the duplicator in their conventional orientation as shown in Example I. After 2500 sheets had been imaged, about 120 spots were observed in the 3 inch wide, 25 square inch strip at the bottom of the test pattern. The decrease in spots or image defects observed was a result of inverting the bottom sheets of the carbonless paper sets so that the oil absorbing coating, which normally functions as a color developer in the carbonless paper set, contacted the bias transfer roller each time a bottom sheet passed through the duplicator. It is believed that the oil absorbing coating absorbed oil that had been transferred to the bias transfer roll from the color former layer of the top sheets, and that the absorption substantially reduced transfer of the oil to the imaging member and subsequent formation of toner deposits on the imaging member that appear as image defect spots on developed images. At the conclusion of the test, the imaging member was carefully cleaned to remove all toner deposits.

EXAMPLE III

Figure 6C:
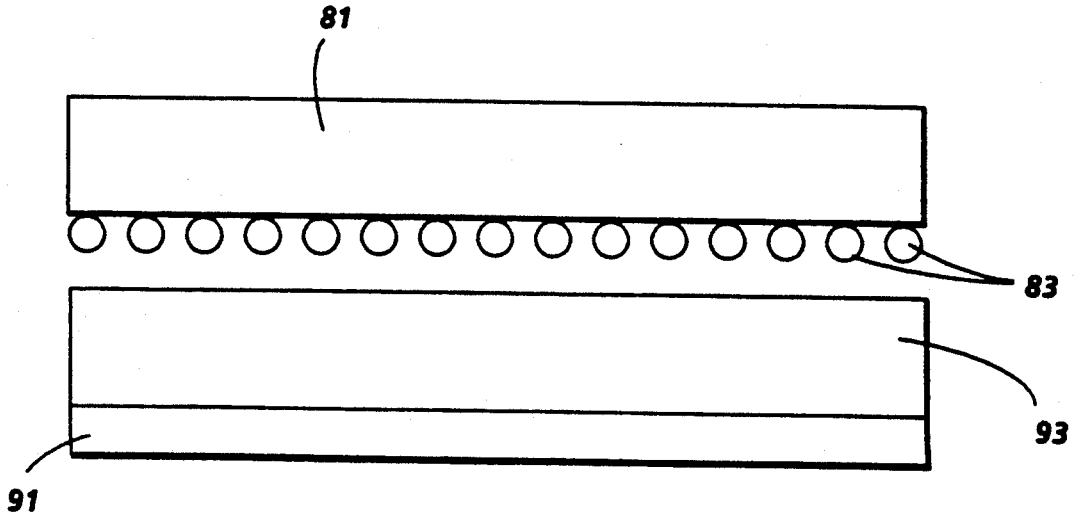

Tartan ® two-part carbonless paper sets available from Minnesota Mining and Manufacturing Company (3M) comprising a top sheet coated on the bottom surface with a color former layer and a bottom sheet coated on the top surface with a color developer layer were disassembled. The bottom sheets were discarded and the top sheets were each paired with a sheet of silica coated paper (FC995 paper, available from Jujo Paper Company Ltd., Japan) so that, as shown in FIG. 6*c*, the silica coating 91 of the bottom sheet 93 was on the surface opposite to the one in contact with the surface of the top sheet 81 coated with the color former layer 83. 1250 of these sets were then incorporated into the main paper tray of a Xerox ® 9900 duplicator. 250 sheets from 125 of these reassembled two-sheet sets were fed through the duplicator and imaged with a test pattern under conditions of 50 percent relative humidity so that the surface of each top sheet 81 containing the color former layer 83 was contacted by the bias transfer roller and the silica coated surface 91 of each bottom sheet 93 contacted the bias transfer roller. Subsequently, 14 sheets of Xerox ® 4024 paper that had been placed in the auxiliary paper tray of the duplicator were imaged by exposing them to a sheet of blank white paper on the platen. This process was repeated with another 250 sheets of the reassembled two-part sets from the main tray and 14 sheets of Xerox ® 4024 paper from the auxiliary paper tray, until 2500 sheets of the carbonless and silica coated papers and 140 sheets of the Xerox ® 4024 paper had passed through the duplicator. Formation of toner deposits on the imaging member during this process was observed by determining the number of spots appearing on the 4024 sheets imaged by exposing them to blank white paper periodically during the process. The average number of spots observed on a "blank" 4024 sheet in a 3 inch wide, 25 square inch strip at the bottom of the sheet as a function of the number of carbonless plus silica coated sheets run is shown by the dotted line and X points in FIG. 7. The individual data points, represented by X points, indicate the number of spots in the strip after each set of 250 carbonless sheets had been passed through the duplicator. The straight dotted line represents a linear regression fit to the data points. As indicated, the number of spots observed decreased significantly compared to the number observed when the carbonless paper sets were passed through the duplicator in their conventional orientation as shown in Example I. After 2500 sheets had been imaged, about 15 spots were observed in the 3 inch wide, 25 square inch strip at the bottom of the test pattern. The decrease in spots or image defects observed was a result of substituting the bottom sheets of the carbonless paper sets with silica coated paper wherein the silica coating contacted the bias transfer roller each time a bottom sheet passed through the duplicator. It is believed that the silica coating absorbed oil that had been transferred to the bias transfer roll from the color former layer of the top sheets, and that the absorption substantially reduced transfer of the oil to the imaging member and subsequent formation of toner deposits on the imaging member that appear as image defect spots on developed images.

EXAMPLE IV

The process of Example III is repeated except that paper coated with calcium silicate having high oil absorptivity (Huber XP974, available from Huber Corporation) was employed as the bottom sheet instead of silica coated paper (FC995 paper). It is believed that results similar to those obtained in Example III will be observed.

Other embodiments and modifications of the present invention may occur to those skilled in the art subsequent to a review of the information presented herein; these embodiments and modifications, as well as equivalents thereof, are also included within the scope of this invention.

What is claimed is:

1. A carbonless paper set consisting of a first sheet, a second sheet, and optional intermediate sheets situated between the first sheet and second sheet, wherein the first sheet comprises paper coated on one surface with a color former and the second sheet comprises paper coated on one surface with a color developer, wherein the first sheet contains an oleophilic pigment filler material on the surface opposite to that coated with the color former and the second sheet contains an oleophilic pigment filler material on the surface opposite to that coated with the color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former.

2. A carbonless paper set according to claim 1 wherein the oleophilic pigment filler material has a pigment surface area of from about 150 to about 400 square meters per gram and exhibits oil absorption of from about 100 to about 450 milliliters per gram.

3. A carbonless paper set according to claim 2 wherein the oleophilic pigment filler material is selected from the group consisting of amorphous silicas, colloidal silicas, fumed silicas, clays, inorganic silicates, and inorganic oxides.

4. A carbonless paper set according to claim 2 wherein the oleophilic pigment filler material is selected from the group consisting of calcium silicate, calcium carbonate, sodium aluminosilicates, and attapulgas clay.

5. A carbonless paper set according to claim 1 which also comprises at least one intermediate sheet of paper, each intermediate sheet being coated on one surface with a color former and coated on the other surface with a color developer.

6. A carbonless paper set according to claim 1 wherein the oleophilic pigment filler material exhibits oil absorption of from about 100 to about 450 milliliters per gram.

7. A carbonless paper set according to claim 1 wherein the oleophilic pigment filler material is selected from the group consisting of amorphous silicas, colloidal silicas, fumed silicas, inorganic silicates, and inorganic oxides.

8. A carbonless paper set according to claim 1 wherein the oleophilic pigment filler material is selected from the group consisting of calcium silicate, calcium carbonate, and sodium aluminosilicates.

9. A carbonless paper set consisting of a first sheet, a second sheet, and optional intermediate sheets situated between the first sheet and second sheet, said first sheet comprising a first paper support comprising paper fibers, said first paper support being coated with a color former, said second sheet comprising a second paper support comprising paper fibers, said second paper support being coated with a color developer, wherein the first sheet contains an oleophilic pigment filler material coated on the surface opposite to that coated with the color former and the second sheet contains an oleophilic pigment filler material coated on the surface opposite to that coated with the color developer, and wherein, when the carbonless paper set is assembled, the surface of the first sheet coated with the color former is in contact with the surface of a sheet coated with the color developer and the surface of the second sheet coated with the color developer is in contact with the surface of a sheet coated with the color former.

10. A carbonless paper set according to claim 9 wherein the oleophilic pigment filler material is coated onto the paper in a binder wherein the binder to pigment ratio is from about 1:1 to about 1:10.

11. A carbonless paper set according to claim 10 wherein the binder is selected from the group consisting of starch, polyvinylalcohol, polyvinylpyrrolidone, styrene-vinylpyrrolidone copolymer, vinyl pyrrolidone-vinylacetate copolymer, styrene-maleic anhydride copolymer, styrene-butadiene copolymers, and mixtures thereof.

12. A carbonless paper set according to claim 10 wherein the oleophilic pigment filler is coated onto the paper at a coating weight from about 3 to about 20 grams per square meter.

13. A carbonless paper set according to claim 9 wherein the oleophilic pigment filler material exhibits oil absorption of from about 100 to about 450 milliliters per gram.

14. A carbonless paper set according to claim 9 wherein the oleophilic pigment filler material is selected from the group consisting of amorphous silicas, colloidal silicas, fumed silicas, inorganic silicates,and inorganic oxides.

15. A carbonless paper set according to claim 9 wherein the oleophilic pigment filler material is selected from the group consisting of calcium silicate, calcium carbonate, and sodium aluminosilicates.

16. A carbonless paper set according to claim 9 wherein the oleophilic pigment filler material has a pigment surface area of from about 150 to about 400 square meters per gram and exhibits oil absorption of from 100 to about 450 milliliters per gram.

* * * * *